US005454889A

United States Patent [19]

McNicol et al.

[11] Patent Number: 5,454,889

[45] Date of Patent: Oct. 3, 1995

[54] PRILL COATING

[75] Inventors: Melvin A. McNicol, Quebec, Canada; Fortunato Villamagna, Slatington, Pa.; J. P. Michel Couture, Beloeil, Canada

[73] Assignees: ICI Canada Inc., Ontario, Canada; ICI Explosives USA Inc., Tamaqua, Pa.

[21] Appl. No.: 109,152

[22] Filed: Aug. 19, 1993

[51] Int. Cl.[6] ..... C06B 45/34

[52] U.S. Cl. ..... 149/7; 149/46; 149/109.6

[58] Field of Search ..... 149/8, 46, 109.6, 149/7

[56] References Cited

U.S. PATENT DOCUMENTS

| | | | |
|---|---|---|---|
| 3,857,805 | 12/1974 | Prickril | 260/28.5 B |
| 4,555,278 | 11/1985 | Cescon et al. | 149/21 |
| 4,780,156 | 10/1988 | Sheeran et al. | 149/21 |

*Primary Examiner*—Donald P. Walsh
*Assistant Examiner*—Anthony R. Chi
*Attorney, Agent, or Firm*—Charles Q. Buckwalter

[57] ABSTRACT

The present invention is directed to intimately combining petroleum products with ammonium nitrate prills forming a coating thereon, whereby said coating is tackified and free flowing.

12 Claims, No Drawings

PRILL COATING

BACKGROUND

The present invention is directed to coatings for ammonium nitrate prills that comprises blends of petroleum products combining the blends with the surface of and penetrating the open pores of the prill to increase tackification of the prill.

A problem in the ammonium nitrate prill art is coating porous and dense prills so that the prills become tackified and remain free flowing. Past coatings have been engineered to make prills free flowing. As a consequence of the free flowing nature of these prills, ammonium nitrate dust is created causing environmental, health, and operational problems. In addition these past coatings do not prolong the shelf life of the ammonium nitrate prill. The blends act as a fuel to the explosion and as a stabilizing medium to the emulsion.

Examples of other attempts to prolong the life of prills are found in U.S. Pat. No. 4,555,278 disclosing the use of an anionic emulsifying agent combined with a fatty acid used to stabilize the prill in a water-in-oil emulsion. U.S. Pat. No. 4,615,751 discloses an explosive which contains a water-resistant agent for inhibiting deterioration of the ammonium nitrate prill.

The present invention uses blends of petroleum products to coat ammonium nitrate prills, both porous and dense. These coated prills are found useful since they improve tackification, reduce dust, and prolong shelf life. As those skilled in this art will recognize this invention is found particularly useful for up-hole loading and is strongly indicated as useful for down-hole loading, in particular, through wet holes.

SUMMARY OF THE INVENTION

A single or plurality of coated prills comprising an ammonium nitrate core intimately combined with a blend of petroleum products said petroleum products communicating with the surface of said prills and penetrating therewithin whereby said prills are tackified and free flowing. In the present invention ammonium nitrate is converted into a prill which then provides a substrate for coating with the petroleum products. The ammonium nitrate core may be either dense or porous as known to those skilled in this art.

The petroleum products that comprise the coating are blends of fuel oil such as No. 2 diesel fuel oil, mineral oil, vegetable oil, and combinations thereof. The other petroleum product that is a part of the blend is slackwax. Slackwax is the wax which results from the incomplete pressing of settlings from petroleum distillates and contains at least 10% by weight and usually 10% to 25% by weight fuel oil.

To apply the petroleum products to the prill the petroleum products are heated to approximately 90 degrees centigrade thus forming a homogeneous melt. This melt is then sprayed over the prills forming a continuous coating. The coating becomes intimately combined with the prill both on the surface and penetrating below the surface of the prill. Porous prills become penetrated to a greater extent than do dense prills. As the coated prill cools below the congelation point of the melt, approximately 55 degrees centigrade. At this temperature the melt forms a homogeneous paste which now coats the prills. At the congelation the coating becomes tacky. This combination is referenced as ANSWAX or ANSWAX prills.

By adjusting the blend ratio, the degree of tackification may be engineered to produce any desired tackiness and flowability. Degree of tackification may depend upon its use on a porous or dense prill. Generally, a 50/50 ratio of slackwax to fuel oil may be applied to both dense and porous prills. The benefit to dense prills is that due to poor dense prill absorption of fuel oil, the 50% slackwax component provides a means to combine the 50% fuel oil with the dense prill. It should be noted that the slackwax itself can provide fuel for an operative explosive in addition to the fuel oil. The benefit to the porous prill is that dust and fines are significantly reduced through the tackification process. It is found that the blends of slackwax to fuel oil may range from 10% to 100% by weight slackwax. Preferably the blend is 30% to 70% slackwax to fuel oil and most preferably, a 50/50 blend of slackwax to fuel oil.

Optionally, flours, such as tapioca, starch, etc. and gums, such as guar, may be applied to the tackified prill to add water resistance. Preferably guar is used as the water resistant addition, most preferably 5% guar is added. Even without the flour and/or gum additions, the present inventive coating also provides considerable water resistance, especially when compared to conventional ammonium nitrate fuel oil (ANFO).

Tackification and free flowing are two physical parameters that trade-off with each characteristic providing separate benefits depending upon which parameters is the more desired. Free flowing prill is important when loading the prill into a blast hole. This is particularly important when pneumatically loading a blast hole. Pneumatic loading normally produces a great deal of fines and dust as well as resulting in blow back. Blow back means that prill that has been loaded is pressured out of the blast hole thus resulting in waste of prill and therefore economic waste. This also increases the environmental and health hazards associated with the loading of bulk explosives.

By use of the present invention, blow back is reduced to a minimal level or completely eliminated. This result is particularly important in the loading of up holes, as known by those skilled in this art. This is obtained due to the tackification. By tackifying the prills essentially the stickiness of the prills provides enough adhesion either to each other or to the walls of the up hole so that the pressures inherent in up hole loading are overcome by the tackification adhesion. Additionally, the present invention is less sensitive to initiation, as has been demonstrated by critical diameter tests. This decrease in sensitivity is believed to be due to the presence of the solid fuel as opposed to a liquid fuel component.

Interestingly, the explosive properties as measured by standard tests in this art, such as velocity of detonation (VOD), critical diameter, and product density are the same or even better than the prior art. It is believed that poorly formed prill can be improved by coating with the present invention.

DESCRIPTION OF THE PREFERRED EMBODIMENTS

The following Examples are provided to further illustrate the present invention and are not intended to limit the scope thereof.

Example 1

A 50:50 slackwax to No. 2 diesel fuel blend was coated on a porous ammonium nitrate prill. The applied coating comprised 6 weight percent of the prill. 23.5 kilograms porous prill was added to a Patterson Ribbon Mixer. 750 grams of slackwax and 750 grams of No. 2 fuel oil were combined and heated to 90 degrees centigrade to form a melt. The melt was added to the prills in the Patterson Mixer, while the mixer was turning at 120 rpm. A waxoline dye was added to the melt to provide a qualitative indication of the homogeneity of the coating. The combination was mixed for 1 minute. The mixer was emptied into boxes and the product was stored in a magazine for two days.

The product was poured into a Blasthole Charger and loaded into a 4 inch diameter by 20 feet in depth simulated up hole. The up hole was comprised of a polyethylene tube with a cap on the end. This up hole was loaded with very little blowback dust. A column of product was formed at the top of the tube. The test was compared to a test with standard ANFO. The blowback dust for the comparative example was intense and the column failed to stick to the simulated up hole. It is noted that a plastic tube is a rigorous test for this purpose due to the low coefficient of friction.

Example 2

The same composition as in Example 1 was used in Example 2. The product was poured into a Penberthy Anoloader and two inch diameter horizontal plastic tube. No blowback was observed. This test was repeated with standard ANFO which resulted in a substantial amount of blowback dust.

The results in the table indicate that the unconfined critical diameter for the purposes of the present invention begins at about 90 mm diameter for detonation velocity to be above 2500 meters per second. Above the 90 mm diameter the VOD results are found acceptable.

TABLE

| Diameter (mm) | ANFO (Km/sec) | ANFO/ANSWAX (Km/sec) | ANSWAX (KM/sec) |
|---|---|---|---|
| 65 | FAIL | FAIL | FAIL |
| 75 | 1.8 | BURN | FAIL |
| 90 | 2.8 | 2.9 | 2.7 |
| 100 | 3.0 | 3.0 | 2.7 |
| 125 | 3.0 | 3.0 | 2.9 |
| 150 | 3.5 | 3.5 | 3.5 |

The water resistance results indicate that the ANSWAX samples had significantly improved water resistance over the ANFO samples. 250 grams of ANSWAX and 250 grams ANFO were separately mixed in 1600 grams of water. Three different immersion times were observed at 5, 10, and 15 seconds. The ANFO samples exhibited water resilience of up to 57.8%, 50.0%, and 45.6% remaining ANFO solids, respectively. The ANSWAX samples for the same time period exhibited a water resilience of 75.6%. 72.4%, and 64.8% remaining ANSWAX solids, respectively. In this water resistance test, samples were immersed and retrieved after the allotted time period.

The opposite test to water resistance is the dissolved solids test. This test mirrored results consistent with the water resistance tests, above. The results indicate that significantly less ANSWAX material dissolved in the solution than ANFO material. An emulsion/ANFO admixture (25/75%) was similarly leached and exhibited a 50.5% leachability of admixture into solution. A similar emulsion/ANSWAX admixture (25/75%) was leached and exhibited 13.3% leachability of admixture into solution.

We claim:

1. A single or plurality of coated prills consisting essentially an ammonium nitrate core intimately combined with slackwax, said slackwax communicating with the surface of said prills and penetrating therewithin whereby said prills are tackified and free flowing.

2. The prills of claim 1 wherein said ammonium nitrate core is porous.

3. The prills of claim 1 wherein said ammonium nitrate core is dense.

4. The prills of claim 1 wherein said slackwax is combined with No. 2 diesel fuel to about 10% to 100% by weight slackwax.

5. The prills of claim 1 wherein said slackwax is combined with No. 2 diesel fuel to about 30% to 70% by weight slackwax.

6. The prills of claim 1 wherein said slackwax is combined with No. 2 diesel fuel to about 50% by weight slackwax.

7. The prills of claim 1 wherein said prills are combined with guar gum.

8. The prills of claim 1 wherein said prills are used in a method of loading up-holes.

9. The prills of claim 1 wherein said prills are used in a method of loading downholes.

10. The prills of claim 1 wherein said prills are used in a method of loading wet downholes.

11. A method of making a single or plurality of prills comprising a core of ammonium nitrate wherein said ammonium nitrated is a) coated with petroleum products heated to about 90 degrees centigrade to form an intimate combination of petroleum product and prill, b) said combination cooled forming petroleum products in communication with said prills, and c) providing prills whereby said prills are tackified and free flowing.

12. The method of claim 11 wherein said petroleum products is slackwax.

* * * * *